United States Patent [19]

Jentoft et al.

[11] Patent Number: 4,514,943

[45] **Date of Patent: * May 7, 1985**

[54] THERMAL BREAK SKYLIGHT

[75] Inventors: Arthur P. Jentoft, Kennebunkport; Paul A. Couture, Emery Mills, both of Me.

[73] Assignee: Wasco Products, Inc., Sanford, Me.

[ * ] Notice: The portion of the term of this patent subsequent to Jun. 21, 2000 has been disclaimed.

[21] Appl. No.: 453,349

[22] Filed: Dec. 27, 1982

Related U.S. Application Data

[62] Division of Ser. No. 175,305, Aug. 4, 1980, Pat. No. 4,388,784.

[51] Int. Cl.[3] ..... E04B 7/18; E06B 7/14; E06B 7/98

[52] U.S. Cl. ..... 52/200; 49/485; 49/DIG. 1

[58] Field of Search ..... 52/200, 72, 403, 397; 49/DIG. 1, 485

[56] References Cited

U.S. PATENT DOCUMENTS

| | | | |
|---|---|---|---|
| 2,276,742 | 3/1942 | Schmidt | 49/487 |
| 2,425,060 | 8/1947 | Gildehaus | 52/200 |
| 2,827,003 | 3/1958 | Stetson | 52/72 |
| 3,434,251 | 3/1969 | Kiekhaefer | 52/398 |
| 3,992,769 | 11/1976 | Jackson | 52/403 |
| 4,073,097 | 2/1978 | Jentoft | 52/200 |
| 4,117,640 | 10/1978 | Vanderstar | 49/DIG. 1 |
| 4,388,784 | 6/1983 | Jentoft et al. | 49/485 |

*Primary Examiner*—John E. Murtagh
*Assistant Examiner*—Kathryn L. Ford
*Attorney, Agent, or Firm*—Wolf, Greenfield & Sacks

[57] ABSTRACT

The skylight may be of the domed-type or flat-type and of single or double glass (acrylic or other transparent or translucent plastic) construction. The skylight fits within an opening in a roof or the like and has a peripheral base that may be constructed of a metal material such as aluminum, and which is fixed to the roof construction about the opening. The base comprises inner and outer base frames separated by a thermal break, a peripheral curb frame disposed over the base, and a retainer for securing the skylight dome over the curb fame. In one embodiment the thermal break is formed by a separate gasket preferably in the form of a premolded butyl tape with a neoprene shim. The curb frame is sealed to the base by means of a hollow second gasket preferably secured to the base but separate from the butyl gasket. In another embodiment, a foam rubber gasket is employed having an enclosed hollow tube for maximum compliance functioning both as the thermal break and as the gasket between the base and the curb frame. The gasket is provided in rectangular sizes corresponding to the opening size with mitred and vulcanized corners thus providing an optimum seal.

26 Claims, 7 Drawing Figures

68
70
20
22
62
56
60
44
50
46
48
68
32
34
24
29
30
28
26
14
18
16
17
58
54
36
38
40
25

130
134
133
122
148
120
150
156
160
158
136
146
138
125
126
128
132
124
129
118
116
144
135
117
154
140
114

THERMAL BREAK SKYLIGHT

This application is a division of application Ser. No. 175,305, filed Aug. 4, 1980 now U.S. Pat. No. 4,388,784, 4/20/83.

BACKGROUND OF THE INVENTION

The present invention relates in general to an improved skylight construction, and is concerned, more particularly, with an improved skylight construction characterized by a simplified gasket arrangement and an improved thermal break. The skylight of this invention has improved thermal performance and herein is described a single element that functions both as a sealing gasket and a thermal break.

In conventional skylight construction, particularly in the skylights for commercial use, the support frame is provided in inner and outer sections joined by a thermal break, which is typically formed by a poured and cured rigid urethane. This thermal break is for minimizing heat transfer through the skylight, and in particular through the heat conductive metal forming the skylight, such as an extruded aluminum. It is most efficient to form the thermal break as the aluminum is being extruded. For the skylight which requires corner mitre welds, the thermal break is essentially destroyed in the vicinity of the weld, and there results a burned-out hole or gap in the thermal break. This usually requires a separate step such as patching with a sealant.

In constructing the aluminum frame with a thermal break, the frame is initially constructed in a single piece, and after the urethane is poured and cured, the gap in the aluminum extrusion is created by sawing or cutting the extrusion lineally at the point where the urethane was poured, thus permitting the urethane itself to hold the two sections of the frame together. It has been found that improved results are obtained and improved adhesion by annodizing the aluminum before placing the thermal break material in the extrusion. However, this pre-finishing step means that other annodized colors cannot be subsequently applied. The urethane cannot tolerate bake oven heat and, thus, baked paint finishes cannot later be applied. Also, the urethane bond would be weakened if annodizing takes place after the urethane is in place, and hence, the general final finishing of the frame is quite restricted.

Accordingly, one object of the present invention is to provide an improved skylight construction having, in particular, an improved thermal break construction.

Another object of the present invention is to provide a skylight construction having improved thermal characteristics particularly adapted for the construction of commercial skylights.

A further object of the present invention is to provide a skylight construction having an improved skylight support frame preferably including inner and outer frames separately constructed and joined by a separate thermal break.

Still another object of the present invention is to provide a skylight construction and a curb frame disposed above the base frame, and further including preferably a foam rubber gasket, in the form of an enclosed hollow tube and which functions both as a thermal break and as the gasket between the base and curb frames.

Still another object of the present invention is to provide an improved form of gasket for use with a skylight that may be provided in an integral one-piece form usually of rectangular construction.

Another object of the present invention is to provide a skylight construction that is characterized by being energy-saving.

SUMMARY OF THE INVENTION

To accomplish the foregoing and other objects of this invention, there is provided a skylight construction adapted to be fitted into an opening in a building such as a commercial building. The skylight construction comprises a curb frame extending about the opening and having means for securing the frame in place about the opening. In one embodiment, a pair of transparent or translucent thermal plastic domes cover the opening and extend at the edges to the curb frame. In another embodiment the dome may be replaced by a pair of acrylic panels. A retainer extends about the periphery of the skylight for holding the dome or panel on the curb frame. The frame comprises a base frame including inner and outer base frames, and an overlying support frame. The support frame and the base frame are preferably constructed of a metal material such as extruded aluminum. The support frame typically has a thermal break that may be of the poured and cured rigid urethane type. The retainer is secured to the support frame. The base frame in accordance with this invention is provided in inner and outer frames that are preferably extruded aluminum with each being welded into a separate frame. A pre-molded gasket then forms a thermal break at the joint between the inner and outer frames. This gasket is preferably a pre-molded butyl (tacky) tape having a neoprene shim embedded therein to maintain the separation between the inner and outer frames. In the preferred embodiment the inner and outer frames are then permanently fixed by means of riveting or the like. It has been found that the minor metal conductivity through these rivets are of virtually no consequence from a standpoint of heat conductivity. A further gasket is provided between the base frame and the support frame overlying the base frame. In accordance with a preferred embodiment of the present invention, a single gasket may be provided preferably of foam rubber in the form of an enclosed hollow tube to provide maximum compliance. Such a gasket functions both as a thermal break in that a section thereof forms the joint between inner and outer frames, and as the gasket that separates the base and the overlying support frame. The improved single gasket that provides both functions is purchased in rectangular form corresponding to the dimensions of the skylight. This gasket is formed in a single piece mitred and vulcanized at the corners. Thus, an optimum seal is achieved with there being a total gasket continuity along with total thermal break continuity.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figures 1, 2:
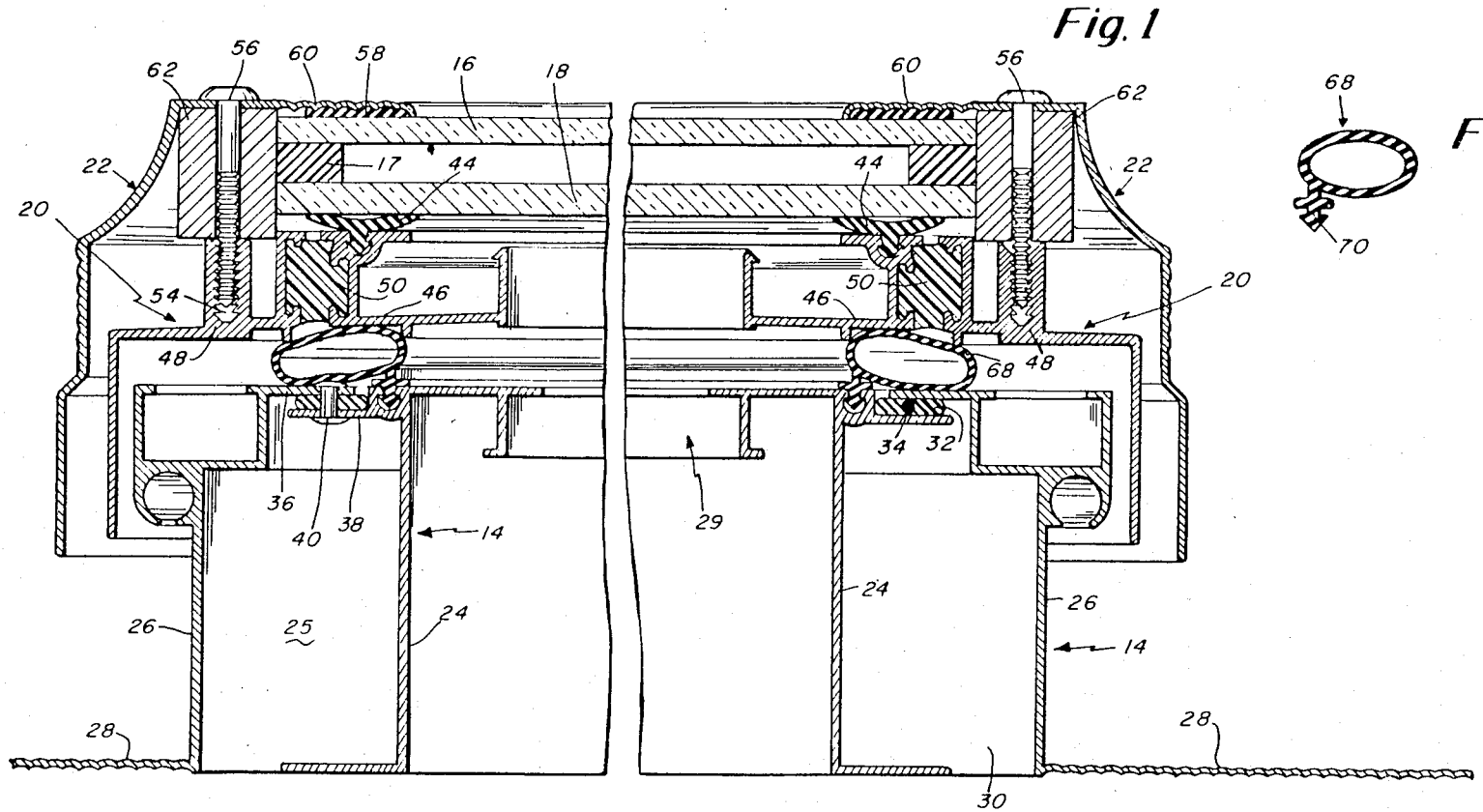
FIG. 1 is a cross-sectional view of a flat-type skylight construction embodying the principles of the present invention.
FIG. 2 is a cross-sectional view of the hollow gasket embodied in the construction of FIG. 1.
Figures 3, 4:
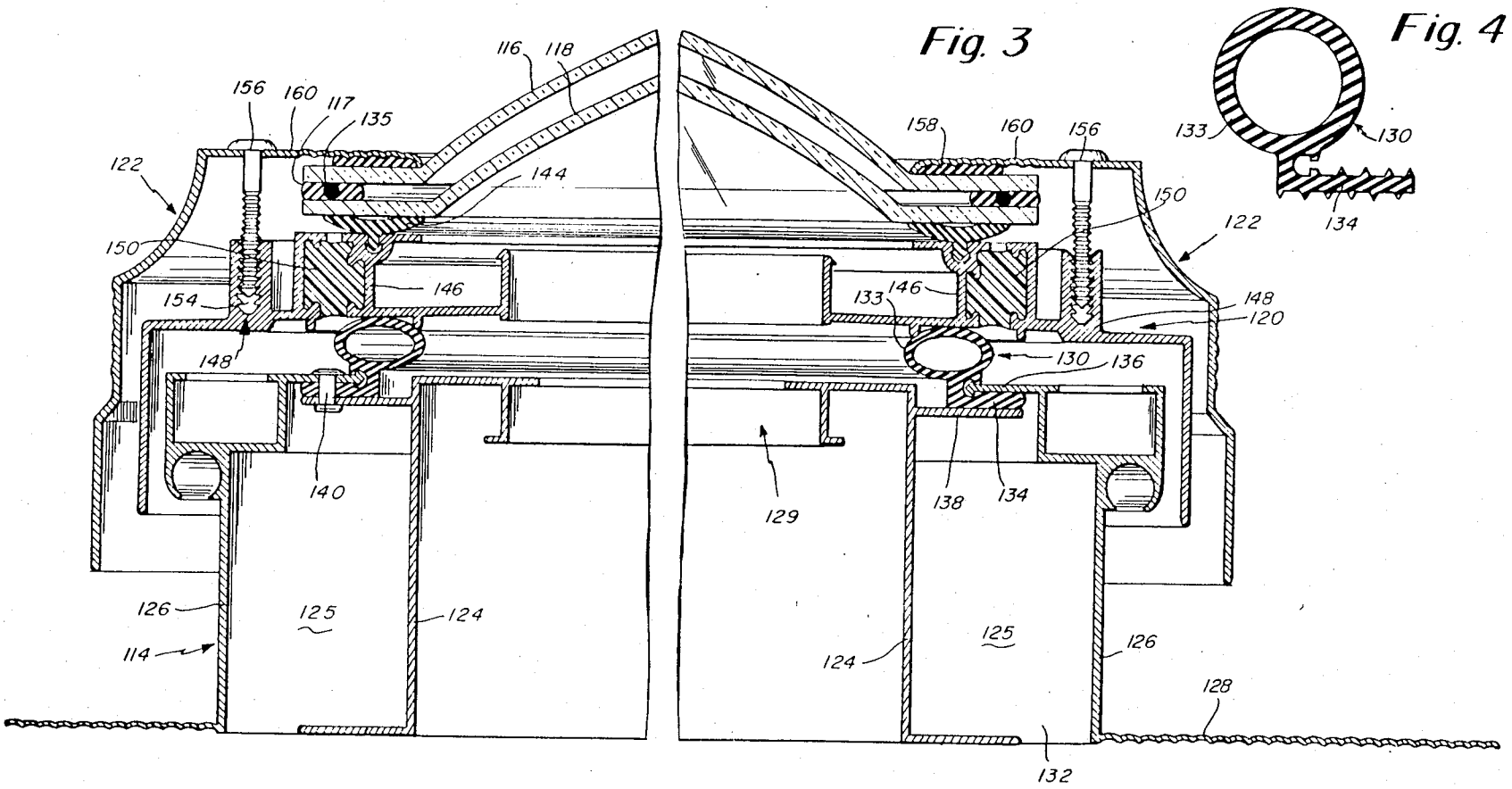
FIG. 3 is a cross-sectional view of a domed skylight construction embodying the principles of the present invention and embodying a gasket or sealing member which functions both as a gasket between skylight elements and a thermal break.
FIG. 4 is a somewhat enlarged cross-sectional view showing the improved gasket and thermal break of the invention as embodied in the skylight of FIG. 3.

With reference now to the drawings and, more particularly, FIG. 1, there is shown one embodiment of the present invention wherein the skylight is of flat construction. A preferred version of the invention is depicted in FIG. 3 in a cross-sectional view with the general form being embodied in a domed skylight construction. The construction of FIG. 1 could as well be used with a domed construction and likewise the construction of FIG. 3 could be used with a flat type skylight construction. A further embodiment of the invention is depicted in the cross-sectional view of FIG. 6.

In the first embodiment shown in FIG. 1, the skylight is of a flat construction, and it is adapted to span an opening which is generally of square or rectangular shape and may be defined by upright walls or by roof construction. The skylight construction shown in this first embodiment includes a pair of glass plates 16 and 18, a base frame 14, an overlying support frame 20, and a retainer 22. The two frames 14 and 20 along with the retainer 22 are preferably constructed of metal. The frames, in particular, may be constructed of an extruded aluminum.

The base frame 14 comprises basically two members including an inner frame 24 and an outer frame 26. These frames may be constructed separately in the form of an aluminum extrusion. These frames define an inner compartment 25 which may contain an insulating material such as a fiberglass insulation or a low density foam core. The outer frame 26 includes a flange 28 for attachment of the entire base frame to a roof construction or the like. The separate inner and outer frames comprising the base frame may individually be welded into separate frames. The inner frame 24 is open as indicated at 29 so that light may pass through the skylight.

In the embodiment of FIG. 1, the thermal break between the inner and outer base frames is formed by a gap 30 at the lower area between these inner and outer frames, and, also, by a pre-molded, tacky, butyl gasket or tape 32 having an embedded hard neoprene shim 34. The shim 34 is for maintaining a substantially constant separation between the leg 36 of outer frame 26 and the leg 38 associated with the inner frame 24. The inner and outer frames are then joined together by means of a series of pop rivets 40. Although these pop rivets are metallic, they have been found to not affect to any great deal the conductivity between the inner and outer frames.

The skylight glass plates 16 and 18 are supported over the intermediate support frame 20 by means of the retainer 22. The plates 16 and 18 are separated by a gasket 17 of a pre-molded butyl which may be in the form of a tape. The lower plate 18 rests upon a cup-shaped sealing gasket 44 which interlocks with the inner section 46 of the support frame 20. The support frame 20 also includes an outer section 48 with there being provided between the sections 46 and 48 a thermal break 50 which may be formed in a conventional manner. The thermal break 50 may be a poured and cured urethane with the urethane thermal break actually interlocking with the sections to maintain them integrally together. The outer section 48 also includes means defining an internally threaded aperture 54 for receiving a securing bolt 56. There are preferably a plurality of these securing bolts or screws that are employed for securing the retainer 22 over the glass plates.

In addition to the gasket 17, there is also provided a second butyl gasket or tape 58 disposed over the top of plate 16 and for sealing between the top surface of the plate 16 and the leg 60 of the retainer. The bolts 56 also pass through the leg 60 outwardly of the tape 58. At least some of the bolts or screws 56 also pass through a glazing stop 62. FIG. 1 shows two of these stops on opposite sides of the glass panels so as to hold these panels in place in a proper position with regard to the retainer.

The upper portion of the skylight construction may be considered as comprising the support frame 20, retainer 22, and glass plates 16 and 18. This entire assembly overlies the base frame 14. A latching arrangement (not shown) may be employed for holding the upper assembly over the base frame. The upper assembly is also movable such as by being tilted so as to at least partially open the skylight. In the closed position, the upper assembly is sealed to the base by means of the hollow gasket 68. This gasket is shown in a cross-section in FIG. 2. This gasket may be made of a rubber material and is preferably a foam rubber gasket having a leg 70 extending therefrom and engageable with a channel in the inner base frame 24. This interlocking of the leg 70 with the frame channel disposes the hollow gasket 68 in an overlying relationship with the joint between the inner frame 24 and the outer frame 26. The gasket 68 essentially overlies the sealing butyl tape 32. It is noted that the hollow gasket 68 also bridges between the inner and outer sections of the overlying support frame 20.

FIGS. 3 and 4 show the preferred embodiment of the present invention wherein the skylight is of a domed construction, and is adapted to span an opening which is generally of square or rectangular shape and may be defined of upright walls or by some predetermined roof construction. The skylight shown in this preferred embodiment includes a pair of acrylic domes 116 and 118, a base frame 114, an overlying support frame 120, and a retainer 122. The two frames 114 and 120 along with the retainer 122 are preferably constructed of metal. For example, the frames may be constructed of an extruded aluminum.

The base frame 114 basically comprises two members including an inner frame 124 and an outer frame 126. These frames may be constructed separately in the form of an aluminum extrusion. The frames define an inner compartment 125 which may contain an insulating material such as a fiberglass insulation or a low density foam core. The outer frame 126 includes a flange 128 which enables attachment of the entire base frame to a roof construction or the like. The separate inner and outer frames comprising the base frame may be individually welded each into its own frame. The inner frame 124 is open as indicated at 129 so that light may pass through the skylight.

In the embodiment of FIG. 3, the thermal break between the inner and outer base frames is formed by an integral foam rubber gasket 130, and by the gap 132 at the lower area between the inner and outer frames. The gasket 130 forms the dual function of providing a thermal break between the inner and outer base frames, and the hollow portion 133 forms a compliant seal for sealing between the base frame and the overlying support frame 120. The leg 134 of the gasket 130 that forms the thermal break between the leg 136 of the outer frame 126 and the leg 138 associated with the inner frame 134. The inner and outer frames are then joined together by means of a series of pop rivets 140. Although these pop rivets are metallic, they have been found to not effect to any great extent the conductivity between the inner and outer base frames.

The skylight domes 116 and 118 are supported over the intermediate support frame 120 by means of the retainer 122. The domes 116 and 118 are separated by a gasket 117 which may be a premolded butyl tape having an embedded hard neoprene shim 135. This shim maintains a relatively constant separation between the parallel edges of the two domes. The lower dome 118 rests upon a cup-shaped sealing gasket 144 which interlocks with the inner section 146 of the support frame 120. The support frame 120 also includes an outer section 148 with their being provided between the sections 146 and 148 a thermal break 150 which may be formed in a conventional manner. The thermal break 150 may be a poured and cured urethane with the urethane thermal break actually interlocking with the sections to maintain them integrally together. The outer section 148 also includes means defining an internally threaded aperture 154 for receiving a securing bolt 156. There are preferably a plurality of these securing bolts or screws that are employed for securing the retainer 122 over the two domes.

In addition to the gasket 117 associated with these domes, and for spacing the domes, there is also provided a second butyl gasket or tape 158 disposed over the top of the edge of dome 116 and for sealing between the top surface of this dome and the leg 160 of the retainer. The bolts 156 also pass through the leg 160 outwardly of the tape 158. At least some of the bolts or screws 156 may pass through a glazing stop, depicted previously in FIG. 1, but not shown in the embodiment of FIG. 3. Because of the configuration of these domes it is generally not necessary to employ stops associated therewith.

The upper portion of the skylight may be considered as comrising the support frame 120, retainer 122, and domes 116 and 118. The entire assembly overlies the base frame 114. A latching arrangement (not shown) may be employed for holding the upper assembly over the base frame. The upper assembly is also movable such as by being tilted so as to at least partially open the skylight. In the closed position, the upper assembly is sealed to the base by means of the hollow compliant section 133 of the combination gasket 130. This gasket is shown in a somewhat enlarged cross-section in FIG. 4. The gasket is preferably made of a rubber material such as a foam rubber having, in addition to the compliant hollow portion 133, a rather elongated leg 134 that fits between the legs 136 and 138 of the base frame to form the thermal break. As mentioned previously, the leg 134 is maintained in place, and the base frame sections are secured together by means of pop rivets 140.

Figure 5:
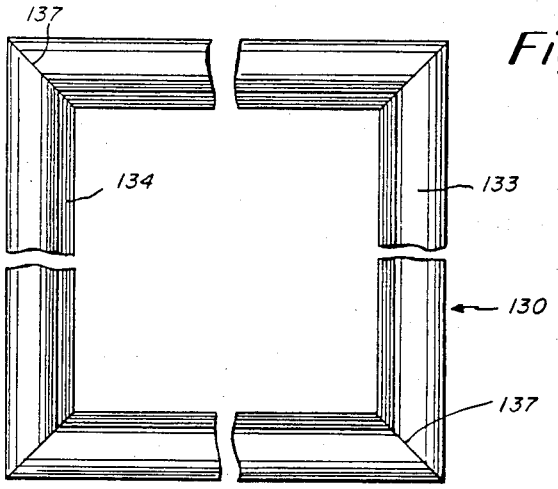
FIG. 5 is a top plan view of the gasket depicted in FIG. 4.

FIG. 5 is a plan view of the gasket shown in FIG. 4. This gasket 130 forms the thermal break, primarily by its leg 134 and at the same time provides a compliant and resilient sealing surface between the base frame and the overlying support frame. This gasket is preferably a foam rubber gasket. As indicated in FIG. 5 the gasket is formed in a rectangle or square to correspond with the size of the opening, and the gasket is mitered and vulcanized at its corners as indicated at 137. Thus, it is a continuous gasket and there is provided an optimum seal. With the continuity of the gasket, there is prevented any later gaps that may occur caused by gasket shrinkage. This was a common problem in the past when a continuous gasket was not employed. Also, the appearance at the corner is appealing because the gasket does not have to bend into an exact right angle to achieve continuity.

Figure 6:
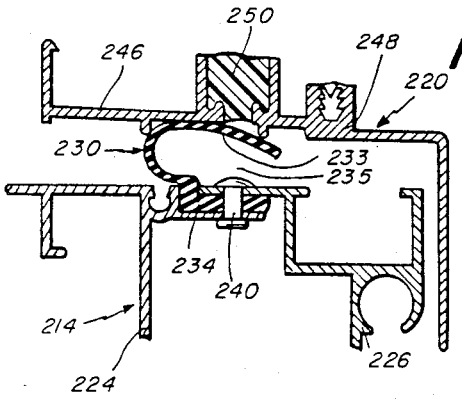
FIG. 6 is a cross-sectional fragmentary view through a portion of the skylight frame showing an alternate gasket arrangement to that depicted in FIG. 4.
Figure 7:
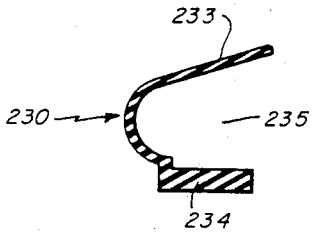
FIG. 7 shows the gasket and thermal break element of FIG. 6.

FIGS. 6 and 7 depict an embodiment of the invention similar to the one depicted in FIG. 3. Thus, in the fragmentary view of FIG. 6, there is shown the base frame 214 which includes inner frame 224 and outer frame 226. The support frame 220 overlies the base frame and includes an inner section 246 and an outer section 248. FIG. 6 also shows the thermal break 250 which is formed between these sections. The primary difference in the embodiment of FIG. 6 is in the configuration of the gasket 230. This gasket may be constructed of foam rubber and, in place of the hollow top, there is provided a compliant top section 233 that is partially open at 235. The gasket depicted in FIG. 6 may be constructed of a somewhat more rigid material than the gasket depicted in FIG. 3. The base of the gasket 230, including the leg 234 is of substantially the same configuration as the gasket 130 of FIG. 4. This is clamped between legs of the inner and outer base frames. FIG. 6 shows the use of a pop rivet 240 as employed previously. FIG. 7 shows the gasket in its non-compressed state with the leg 233 extending upwardly from the horizontal. FIG. 6 depicts the gasket when it is compressed with the leg 233 then extending downwardly from the horizontal.

What is claimed is:

1. A skylight construction for an opening in a building comprising;

a frame means extending about the opening and including means securable about the opening, translucent or transparent means covering the opening and extending at edges to overlie the frame means, means for retaining the covering means on the frame means, said frame means comprising a base frame and a support frame overlying the base frame, and a compliant sealing means extending contiguously about and overlying the base frame and for sealing between the base frame and support frame, said base frame having thermal break means for minimizing heat transfer through the base frame, said support frame including an inner frame section, an outer frame section and second thermal break means disposed between and joining the inner and outer frame sections, said thermal break means being non-metallic and extending between the inner and outer frame sections about the periphery thereof.

2. A skylight construction as set forth in claim 1 wherein said covering means includes at least one plate means.

3. A skylight construction as set forth in claim 2 including a pair of glass plates.

4. A skylight construction as set forth in claim 1 wherein said covering means includes at least one acrylic dome.

5. A skylight construction as set forth in claim 4 including a pair of domes.

6. A skylight construction as set forth in claim 1 wherein said retaining means includes a retainer having one side extending downwardly about the base frame and another side extending inwardly to contact the edge of the covering means.

7. A skylight construction as set forth in claim 6 including securing means for securing the retainer to the support frame sandwiching the edge of the covering means between the support frame and the other side of the retainer.

8. A skylight construction as set forth in claim 1 wherein said base frame comprises an inner base frame and an outer base frame, said base frame being constructed of metal and separately formed of straight pieces to form individual frames and means defining a heat insulating thermal break between inner and outer frames.

9. A skylight construction as set forth in claim 8 wherein said thermal break includes a compressible tape having shim means to limit the separation between the inner and outer frames.

10. A skylight construction as set forth in claim 9 wherein the inner and outer frames each includes a leg, one leg overlying the other with the tape therebetween, and means securing the legs together.

11. A skylight construction as set forth in claim 1 including a cup-shaped gasket carried by the support frame and upon which the covering means rests.

12. A skylight construction as set forth in claim 1 wherein said sealing means is a hollow gasket with an integral thermal break that also forms an anchor point for the compliant sealing means.

13. A skylight construction as set forth in claim 12 wherein said hollow sealing means is of a rubber material.

14. A skylight construction as set forth in claim 12 wherein said hollow sealing means is partially open.

15. A skylight construction for an opening in a building as described in claim 1 wherein said inner frame section has an upright wall forming a means on one side for holding the second thermal break means and forming on the other side thereof at least a part of a condensation gutter.

16. A skylight construction for an opening in a building as described in claim 15 including a gasket carried by and overlying the inner frame section.

17. A skylight construction for an opening in a building as described in claim 16 including means defined in the inner frame section over the upright wall for retaining the gasket in place.

18. A skylight construction for an opening in a building as described in claim 17 wherein said base frame comprises an inner base frame and an outer base frame, said base frame being constructed of metal and separately formed of straight pieces to form individual frames, said compliant sealing means having means for securing to one of said inner and outer base frames, said compliant sealing means having a continuous surface adapted for engaging both said inner frame section and outer frame section under said second thermal break means.

19. A skylight construction for an opening in a building as described in claim 1 wherein said base frame comprises an inner base frame and an outer base frame, said base frame being constructed of metal and separately formed of straight pieces to form individual frames, said compliant sealing means having means for securing to one of said inner and outer base frames, said compliant sealing means having a continuous surface adapted for engaging both said inner frame section and outer frame section under said second thermal break means.

20. A skylight construction for an opening in a building comprising:

a frame means extending about the opening and including means secureable about the opening, translucent or transparent means covering the opening and extending at edges to overlie the frame means, means for retaining the covering means on the frame means, said frame means comprising a base frame and a support frame overlying the base frame, and a compliant sealing means extending contiguously about and overlying the base frame and for sealing between the base frame and the support frame, said support frame including an inner frame section, an outer frame section and thermal break means disposed between and joining the inner and outer frame sections, said thermal break means being interlocked with said inner and outer frame sections to form therewith an integral support frame.

21. A skylight construction for an opening in a building as described in claim 20 wherein said inner frame section has an upright wall forming a means on one side for holding the second thermal break means and forming on the other side thereof at least a part of a condensation gutter.

22. A skylight construction for an opening in a building as described in claim 21 including a gasket carried by and overlying the inner frame section.

23. A skylight construction for an opening in a building as described in claim 22 including means defined in the inner frame section over the upright wall for retaining the gasket in place.

24. A skylight construction for an opening in a building as described in claim 17 wherein said outer frame section has means for receiving a fastener for securing the retaining means to the outer frame section.

25. A skylight construction for an opening in a building comprising;

a frame means extending about the opening and including means securable about the opening, translucent or transparent means covering the opening and extending at edges to overlie the frame means, means for retaining the covering means on the frame means, said frame means comprising a base frame and a support frame overlying the base frame, and a compliant sealing means extending contiguously about and overlying the base frame and for sealing between the base frame and support frame, said base frame having thermal break means for minimizing heat transfer through the base frame, said support frame including an inner frame section, an outer frame section and second thermal break means disposed between and joining the inner and outer frame sections, said base frame comprising an inner base frame and an outer base frame, said base frame being constructed of metal and separately formed of straight pieces to form individual frames, said compliant sealing means having means for securing to one of said inner and outer base frame, said compliant sealing means having a continuous surface adapted for engaging both said inner frame section and outer frame section under said second thermal break means.

26. A skylight construction for an opening in a building comprising;

frame means extending about the opening and including means securable about the opening, translucent or transparent means covering the opening and extending at edges to overlie the frame means, means for retaining the covering means on the frame means, said frame means comprising a base frame and a support frame overlying the base frame, and a compliant sealing means extending contiguously about and overlying the base frame and for sealing between the base frame and the support frame, said support frame including an inner frame section, an outer frame section and thermal break means disposed between and joining the inner and outer frame sections, said thermal break means being dove-tailed interlocked with said inner and outer frame sections to form therewith an integral support frame, said inner frame section having an upright wall forming a means for holding the thermal break means, a gasket carried by and overlying the inner frame section, means defined in the inner frame section over the upright wall for retaining the gasket in place.

* * * * *